United States Patent [19]

Ochiai

[11] 4,123,277

[45] Oct. 31, 1978

[54] COPOLYMER SUBBING MATERIAL FOR PHOTOGRAPHIC ELEMENTS

[75] Inventor: Takeji Ochiai, Fujimiya, Japan

[73] Assignee: Fuji Photo Film Co., Ltd., Minami Ashigara, Japan

[21] Appl. No.: 780,881

[22] Filed: Mar. 24, 1977

Related U.S. Application Data

[63] Continuation of Ser. No. 499,360, Aug. 21, 1974, abandoned.

[30] Foreign Application Priority Data

Aug. 21, 1973 [JP] Japan ..... 48/93578

[51] Int. Cl.[2] ..... G03C 1/86; G03C 1/94; G03C 5/54; G03C 1/78

[52] U.S. Cl. ..... 96/85; 96/87 R; 96/29 R; 96/75; 96/76 R

[58] Field of Search ..... 96/87 R, 85, 76, 75, 96/29 R

[56] References Cited

U.S. PATENT DOCUMENTS

| | | | |
|---|---|---|---|
| 3,573,951 | 4/1971 | Abbott et al. | 96/87 R |
| 3,600,208 | 8/1971 | Abbott et al. | 96/87 R |
| 3,674,531 | 7/1972 | Shephard et al. | 96/87 R |
| 3,713,829 | 1/1973 | Nishio et al. | 96/87 R |
| 3,751,280 | 8/1973 | Nerurkur et al. | 96/87 R |
| 3,778,272 | 12/1973 | Hepher | 96/87 R |
| 3,847,620 | 11/1974 | Iguchi et al. | 96/114 |

*Primary Examiner*—Jack P. Brammer

*Attorney, Agent, or Firm*—Sughrue, Rothwell, Mion, Zinn and Macpeak

[57] ABSTRACT

A photographic element which comprises a resin film or resin coated paper support having superimposed thereon a layer of a composition comprising a copolymer containing therein the moiety of the general formula (I)

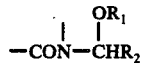

(I)

wherein $R_1$ and $R_2$ each is a hydrogen atom or an alkyl group having 1 to 12 carbon atoms.

31 Claims, No Drawings

COPOLYMER SUBBING MATERIAL FOR PHOTOGRAPHIC ELEMENTS

This is a continuation of application Ser. No. 499,360, filed Aug. 21, 1974 now abandoned.

BACKGROUND OF THE INVENTION

1. Field of the Invention

The present invention relates to a method of forming a subbing layer on a film of or paper coated with a resin, e.g., a polyester resin, and a photographic element containing a film of or paper coated with a resin, e.g., a polyester resin having a subbing layer thereon. Particularly, the present invention relates to a method of forming a subbing layer on a linear polyester film for photographic use which is biaxially stretched, oriented and crystallized.

2. Description of the Prior Art

It is difficult to obtain a sufficient adhesive strength between a hydrophilic photographic emulsion and a film of or paper coated with a resin, e.g., a polyester resin, because resins such as polyester-type high molecular weight materials are hydrophobic since they have a high crystallinity and are linear high molecular weight materials having chemically inactive functional groups.

As a means for improving the adhesion between a film of or paper coated with a resin, e.g., a polyester resin, and a photographic emulsion in the prior art, many methods wherein the film of or paper coated with a resin is treated so as render the surface hydrophilic are known. For example, (1) a method for improving adhesion which comprises carrying out a surface treatment such as a chemical treatment (U.S. Pat. Nos. 3,145,242 and 3,376,208, etc.), a flame treatment (U.S. Pat. No. 3,072,483 and British Pat. No. 788,365, etc.), an ultraviolet light treatment, (U.S. Pat. Nos. 3,475,193 and 3,360,448, etc.), a high frequency treatment, a glow discharge treatment, an active plasma treatment or an ultraviolet laser treatment, etc., and applying a photographic emulsion to the treated surface of the film or coating, and (2) a method which comprises applying a primer to the film or coating the surface which has been subjected to the above described surface treatment (1) and applying then a photographic emulsion thereto are known.

However, these methods have many defects as set forth below. Chemical treatment has the defect that the composition of the solution changes with the lapse of time. Further, steps such as rinsing and drying in order to remove residual treating solution (e.g., sulfuric acid and chromic acid, etc.) after the chemical treatment must be conducted. Furthermore, a method which comprises carrying out a surface treatment using a solvent which swells or dissolves the resin (etching solution) is known. However, in this case, difficulties with respect to the planarity of the film of or paper coated with a resin occur because the modulus of elasticity of the resin support decreases due to the etching agent used and contraction occurs in the latter part of the drying step. In carrying out drying under conditions whereby the planarity of the support can be well maintained, fog sometimes occurs in the photographic emulsions coated thereon because of residual swelling agent or solvent in the resin support. In addition, the swelling agent is quite permeable to the skin or has an offensive smell resulting in a deterioration of the ability to handle the swelling agent. Particularly, phenolic compounds have the disadvantage of pathologically adversely affecting users who are in contact with these compounds over a long period.

In the ultraviolet light treatment, the adhesive strength to the emulsion layer barely increases even if the film of or paper coated with a resin is exposed to ultraviolet light at normal temperature. In order to obtain good adhesion in this method, the film of or paper coated with a resin support must be heated to a high temperature (for example, above 100° C.) during the application of the ultraviolet light.

In this case, the support planarity is easily damaged due to a decrease in the modulus of elasticity from the ultraviolet light treatment, a contraction from the heat and the uneveness of the heat transmission due to a difference in thickness. Further, where the planarity of the support is damaged by contraction, difficulties, for example, wrinkles, occur during this step. In addition, this method is not desirable since ultraviolet lamps have a short high intensity life and are very expensive.

In the corona discharge treatment, when electrostatic charges are accumulated on the surface of the film of or paper coated with a resin by corona discharging, the charges are injected into the film to become a leakage current, and a polar group having a strong dipole moment in the resin functions as a trapping center to the movement of the accumulated charges. A lower molecular weight polymer layer which is formed by oxidation and deterioration is formed on the surface of the resin film subjected to corona discharging. Although the resin film subjected to such a treatment has good printability, the improvement of adhesion for photographic emulsions which require a high stripping resistance for the hydrophilic layer is insufficient. Further, it is necessary to heat the resin support to the temperature above a glass transition temperature thereof, and thus the same undesirable results as in the case of the ultraviolet light treatment occur.

In other methods for surface treatment, many difficulties occur and sufficient adhesion can not be obtained.

Namely, in these surface treatments, the surface of the photographic film is decomposed by oxidation. Accordingly these treatments sometimes cause a fatal defect in the photographic industry, because not only does the quality of the resin deteriorate but also fogging of the photographic emulsions easily occurs due to a very small amount of oligomer or acetaldehyde formed by the decomposition. In carrying out these surface treatments, since the limiting viscosity of the resin is reduced and the molecular weight thereof is decreased, disadvantageously the properties remarkably change when the waste polyester is reused. Further, elimination of pollution problems must be considered, because a resin, such as a polyester, is a comparatively expensive high molecular weight material and the cost of disposal is high because the polyester resin is difficult to burn or melt. In order to reuse the resin and to hold down the cost of additional equipment, a method which does not require a surface treatment would be advantageous.

A method for improving adhesion between the polyester film and the photographic emulsion layer using an emulsion polymer as a primer without applying any surface treatment has been described in, for example, U.S. Pat. No. 3,615,556 (Japanese Patent Publication No. 35641/1973), wherein a copolymer of (1) butadiene, (2) an ethylenically unsaturated carboxylic acid and (3) one other ethylenically unsaturated monomer copolymerizable therewith is superimposed on a polyester film. However, it has been found that this method has a very important defect as shown in the following examples when it is utilized as a method of forming a subbing layer for photographic emulsions. Namely, it has been found that adhesion between the photographic emulsion layer and the polyester film is quite insufficient when the polyester film is subjected to intense external stress, for example, from an automatic developing apparatus, while undergoing chemical change during development, fixing and rinsing or treatment in the presence of chemicals. This is because the copolymer used in the prior art has only acid functional groups, giving rise to the following defects: (1) self-cross-linking is insufficient when applied to the polyester film and dried, (2) the adhesive strength is remarkably reduced because the copolymer readily dissolves in conventional developers containing sodium sulfite and hydroquinone, and (3) each coated surface exhibits a blocking phenomenon to each other due to absorption of moisture in the air by the free acid groups after the film is rolled in a dry state giving rise to difficulties and resulting in a non-uniform quality with the lapse of time after winding. This blocking phenomenon is observed in Example 2 of U.S. Pat. No. 3,615,556. In that patent, an improvement has been attempted by removing the blocking which comprises increasing the styrene content, that is, decreasing the butadiene content, to reduce the residual amount of unsaturated double bonds in the copolymer or by applying an aqueous gelatin solution containing 3 wt.% of formaldehyde based on the weight of the gelatin to a surface of the butadiene copolymer layer as a double layer method where the acid group content is increased 4 or 5 times by weight.

However, according to the present invention, it is possible to form a subbing layer having a good anti-blocking property using only one application. Further, it has been found in the present invention that the subbing layer has good resistance to scratching as shown hereinafter, excellent anti-blocking properties and an improved slipping effect, which are superior to the case where a polymer having only acid groups which forms a soft subbing layer is used.

In addition, according to the above described patent, the disclosure is that a preferred degree of adhesion can not be obtained if the acid content is below 0.5% by weight (Japanese Patent Publication No. 3564/1973, column 4, line 30 although this is not described in detail in the U.S. patent), which is very different from the present invention. In using the copolymer of the present invention, there is the advantage that organic solvents are not substantially used. Furthermore, using the copolymer of the present invention, a surface treatment of the film of or paper coated with a resin is not always necessary.

SUMMARY OF THE INVENTION

In the present invention, a remarkably excellent effect can be obtained as shown in the Examples given hereinafter by using a polymer containing an N-alkanolamide moiety or an N-alkoxyalkylamide moiety as compared with using a latex containing a large amount of an acid component as in the prior art. Furthermore, according to the present invention, it has been found that the copolymer of the present invention is very suitable as a subbing layer even if the acid component is as low as about 0.01 to 5% and particularly 0.01 to 0.49% by weight. Particularly, the fact that the acid component can be reduced is one of the most important advantages from the standpoint of maintaining the stability of the latex. If the acid component is present in a large amount, the latex easily precipitates and undergoes a chemical change.

As a result of studies for developing a new economical method of forming a subbing layer in order to obtain very high adhesive strength without the need for any surface treatment, the present invention has been achieved.

The present invention comprises applying a copolymer of (A) a monomer having a moiety of the following formula

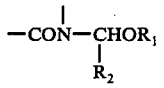

wherein $R_1$ and $R_2$ is a hydrogen atom or an alkyl group having 1 to 12 carbon atoms, (B) a monomer which provides a carboxyl group and (C) a hydrophobic monomer to a support comprising a film of or paper coated with a resin and particularly a linear polyester support which is biaxially stretched, oriented and crystallized.

An additional embodiment of this invention comprises a photographic element which comprises a resin film or resin coated paper support having superimposed thereon a layer of a composition comprising a copolymer containing therein the moiety of the general formula (I)

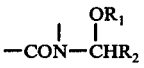

(I)

wherein $R_1$ and $R_2$ each is a hydrogen atom or an alkyl group having 1 to 12 carbon atoms.

DETAILED DESCRIPTION OF THE INVENTION

As the above described component (A), addition polymerizable monomers are particularly preferred.

Preferred amounts of these monomers are (A) N-alkanolamide group or N-alkoxyalkylamide group containing component: about 0.01 to 15% by weight and particularly 0.01 to 8% by weight, (B) the component which provides a carboxy group: about 0.01 to 5% by weight and particularly 0.01 to 0.49% by weight and (C) the hydrophobic monomer: about 20 to 80% by weight. Although these monomers can be polymerized using many techniques, an emulsion polymerization process and a latex polymerization process are particularly preferred, because aqueous solvents can be used. A suitable molecular weight range is about 10,000 to 1,000,000. An aqueous dispersion of the resulting latex is applied as a primer to a film of or paper coated with a resin, by which the adhesive strength to the photographic emulsion layer is remarkably improved. Particularly, the present invention relates to a method of forming a subbing layer on a photographic support which comprises using the N-alkanolamide copolymer.

Suitable resins include linear polyester films such as a polyester of an aromatic dicarboxylic acid and an aliphatic diol such as polyethylene terephthalate, polycondensed polyesters composed of terephthalic acid-isophthalic acid and a glycol, poly-1,4-cyclohexadiol terephthalate and polyethylene naphthalene dicarboxylate, etc. A suitable degree of stretching is about 2 to 3 times, preferably 3.5 to 3.7 times, in one direction and about 2 to 5 times, preferably 3.3 to 3.4 times, in a perpendicular direction thereto.

The photographic emulsion layer which can be used in the present invention will be illustrated briefly in the following.

Suitable examples of binders for the photographic emulsion layer (hydrophilic organic protective colloid) are synthetic and natural hydrophilic high molecular weight compounds. Examples of these compounds include gelatin, acylated gelatin such as phthalated gelatin and maleated gelatin, cellulose derivatives such as carboxymethyl cellulose and hydroxyethyl cellulose, grafted gelatin which is produced by grafting acrylic acid, methacrylic acid or amides thereof to gelatin, polyvinyl alcohol, polyhydroxyalkyl acrylates, polyvinyl pyrrolidone, vinyl pyrrolidone-vinyl acetate copolymers, casein, agarose, albumin, sodium, alginate, polysaccharides, agar agar, starch, grafted starch, polyacrylamide, polyethylene imide acrylated materials, and homopolymers and copolymers of acrylic acid, methacrylic acid, acrylamide, N-substituted acrylamide or N-substituted methacrylamide and the partially hydrolyzed products thereof. These materials can be used individually or as a mixture of two or more thereof. These materials are described in detail in U.S. Pat. Nos. 2,286,215, 2,322,085, 2,327,808, 2,541,474, 2,563,791, 2,768,154, 3,808,331, 2,852,382, 3,062,674, 3,142,586, 3,193,386, 3,220,844, 3,287,289 and 3,411,911, and German Pat. Nos. 1,003,587 and 1,046,492, etc.

As long as the binder is composed of the above-described hydrophilic high molecular weight compounds, the material included in the binder is not very important in the present invention. However, usually, the binder can contain silver halide, physical development nuclei as used in a diffusion transfer process such as silver sulfide or noble metal colloids or sensitive materials such as diazo compounds or can contain many kinds of additives, couplers and carbon black, etc.

As described above, firm adhesion of the photographic layer to the hydrophobic resin film is difficult to achieve directly in the prior art, because the binder of the photographic layer is hydrophilic. If desired, two or more compatible mixtures of the above-described binders can be used. Of the above described binders, gelatin is most commonly used and a part or all of the gelatin can be replaced by other synthetic high molecular weight materials or by the so-called gelatin derivatives, i.e., acylated materials or grafted materials thereof. The use of gelatin is illustrated in detail in the following.

It already is well known that polybutadiene-type copolymers are most preferred in order to remove the residual stress of the gelatin emulsion layer at drying. However, improvement in the adhesive properties is not yet sufficient. The reason why the composition used in the present invention forms a coated material having good adhesive properties to the photographic emulsion layers, that is, hydrophilic layers such as gelatin layers, is not at present completely clear. However, while not desiring to be bound, it is believed that a butadiene-styrene portion as a hydrophobic moiety in the copolymer composition enhances the adhesive strength to the hydrophobic polyester surface, while a portion having an N-alkanolamide or N-alkoxyalkylamide group and a carboxyl group as a hydrophilic moiety in the copolymer enhances the adhesive strength to hydrophilic materials. The material used for the hydrophilic layer, for example, gelatin dissolves only in water and is composed of repeating $\alpha$-amino acid units, i.e., polypeptide chains. The amino acid residue composition which links to a methine group of the polypeptide chain generally is $\frac{1}{3}$ glycine, $\frac{1}{3}$ proline and oxyproline, and $\frac{1}{3}$ amine acids. From this chemical structure, it could be supposed when the N-alkanolamide groups are introduced into the copolymer used for a primer, the adhesive strength to gelatin remarkably increases as compared with the use of a polymer composed of a carboxyl group containing monomer and a hydrophobic monomer as in the prior art. Further, the adhesive strength of the resin film support in a wet condition to the photographic emulsion containing gelatin as a main binder component remarkably increases, because a self-cross-linking property is obtained by heating of the N-alkanolamide group or N-alkoxyalkylamide group.

A characteristic of the present invention is in the use of a copolymer of the above-described monomer (A) for the resin film.

The monomer (A) can be characterized as containing the following moiety:

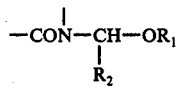

wherein $R_1$ and $R_2$ each represents a hydrogen atom or an alkyl group having 1 to 12 carbon atoms.

Materials containing the above-described moiety and an addition polymerizable group such as a vinyl group or a vinylidene group, etc. can be used as Component (A). Namely, if a residue having an addition polymerizable group designated Ap is shown, the monomer unit (A) of the present invention contains the group represented by the formula

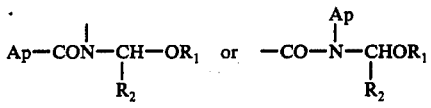

Further, maleamide derivatives are suitable.

Examples of monomers having such a group include derivatives of acrylic acid, methacrylic acid, itaconic acid and maleic acid, etc. such as N-methylol acrylamide, N-methoxymethyl acrylamide, N-ethyl-N-methylol acrylamide, N,N-dimethylol acrylamide, N-$\alpha$-hydroxyethyl acrylamide, N-$\alpha$-hydroxypropyl acrylamide, N-methyoxymethyl acrylamide, N-methylol methacrylamide, N-butoxyethyl methacrylamide, N-methylol maleamide, N-methylol-N-butyl acrylamide, N-methylol-N-ethyl acrylamide, N-$\alpha$-butoxymethyl acrylamide, N-methylol itaconamide, N-methylol-$\alpha$-ethyl propionamide and N-methylol-$\beta$-acetamide ethyl acrylamide, N,N-dimethylolacrylamide and vinyl aromatic compounds, vinyl ether derivatives and vinyl ester derivatives such as N-methylol-p-vinylbenzamide, N-methylol-$\beta$-vinyloxyethyl acetamide and N-methylol-vinyl-$\alpha$-acetamide acetate, etc. One or more of these monomers can be selected depending on the purposes of use. These monomers can in general be represented by the general formula shown below

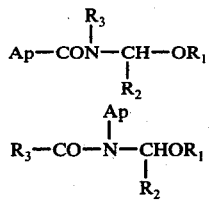

wherein Ap, $R_1$ and $R_2$ are as hereinbefore described, and $R_3$ is a hydrogen atom or a hydrocarbon group having from 1 to 12 carbon atoms.

The N-α-alkoxyalkylamide derivatives are less effective than the N-α-hydroxyalkyl derivatives, if they are not heated for a somewhat longer time (about 2 times longer). Among these compounds, N-methylol acrylamide is most preferred because it has good adhesive properties, is easily cross-linked and is easily available in the market.

The N-α-hydroxyalkylamide moiety and the N-α-alkoxyalkylamide moiety can be synthesized by reacting the corresponding amide with an aldehyde such as formaldehyde or acetaldehyde or reacting further with an alcohol such as methanol, ethanol, butanol, propanol, pentanol or cyclohexanol.

Examples of the monomer (B) which yields a —COOH group include acrylic acid, methacrylic acid, ethacrylic acid, chloroacrylic acid, maleic acid, fumaric acid, itaconic acid, mesaconic acid, citraconic acid, sorbic acid, acryloxypropionic acid and the acid anhydrides of these acids. Of these compounds, acrylic acid, methacrylic acid, itaconic acid and acryloxypropionic acid are particularly preferred. These acids can be used individually or as a mixture of two or more thereof. These monomers can be in general represented by the general formula Ap—COOH and Ap—COOM wherein Ap is as hereinbefore defined and M is a group such as an ammonium group easily hydrolyzable to a carboxylic acid group.

The branched chain alcohol esters of the above-described organic acids can also be used as component (B). Examples of branched chain alcohols are secondary and tertiary alcohols with those having 3 to 8 carbon atoms such as isopropanol, isooctanol, t-butanol, t-amyl alcohol and t-octyl alcohol, etc. being preferred.

In using the branched alcohol esters, there is an advantage that comparatively stable polymers such as polymer emulsions can be produced, because they do not function as an acid during the polymerization. The tert-alkyl ester group hydrolyzes in water or in the presence of moisture to form a carboxyl group as follows when heated.

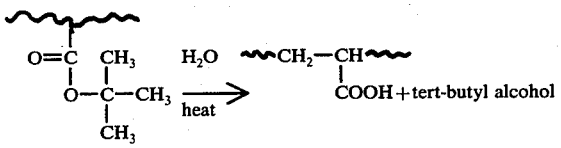

One or more hydrophobic monomers (C) can be selected from the acrylates, methacrylates, olefins, dienes, vinyl aromatic compounds, vinyl ethers and vinyl esters. Examples of such monomers include butadiene, isoprene, styrene, methylstyrene, acrylonitrile, acrylates and methacrylates (e.g., methyl, ethyl, butyl and propyl, etc.), vinyl ethers (e.g., methyl, ethyl, chloroethyl and butyl, etc.) and vinyl esters (e.g., vinyl acetate and vinyl propionate, etc.). Of these monomers, mixtures of a diene, such as butadiene or isoprene, and a monomer selected from the group consisting of styrene, acrylonitrile, the acrylates and the methacrylates are particularly preferred. These monomers can be in general represented by the general formula $ApR_4$ wherein Ap is as hereinbefore defined and $R_4$ is an aliphatic or aromatic group.

Copolymers composed of about 0.1 to 15% by weight and preferably 2 to 8% by weight of Component (A), about 0.01 to 6% by weight and preferably 0.01 to 0.49% by weight of Component (B) and Component (C) which comprise about 10 to 80% by weight and preferably 25 to 65% by weight of a diene component with the balance being another hydrophobic monomer or monomers can be suitably utilized.

In the present invention, copolymers having such a composition can be conventionally used.

In order to produce the copolymers of the present invention, solution polymerization, bulk polymerization and latex polymerization, etc. which are well known polymerization techniques, for example, as described in Japanese Patent Publication No. 914/1966 and U.S. Pat. No. 3,079,434, can be utilized.

Of these methods of producing polymers, a latex polymerization and an emulsion polymerization are particularly preferred because these polymerizations have the following advantages;

(1) the processes are not carried out in organic solvents, (2) polymers having a high molecular weight can be obtained, (3) a high conversion of monomer can be achieved, and (4) the processes are easily conducted.

In the emulsion polymerization method, it is particularly advantageous to use esters of the above-described branched chain alcohols from the standpoints that (1) a homopolymer of acrylic acid or methacrylic acid can be easily formed because these monomers have a high polymerization reactivity, (2) a high carboxyl group content can be obtained and the latex is unstable. Further, in using the carboxyl group-containing monomers, it must be noted that a sufficient effect can be obtained by using them in a very small amount for the copolymer of the present invention.

The effect of the present invention can be attained to a certain degree, if a unit having an N-alkanolamide group or an N-alkoxyalkylamide group or a unit having these groups and a COOH group is present in a small amount in the polymer used as a binder. However, if the amount of this unit is too large, the same effect as in the prior art is obtained and a blocking phenomenon of the subbing layers ocuurs. Accordingly, use in the above described range is suitable.

The adhesion effects of the copolymers of the present invention have already been described to be very superior to those achieved in the prior art, for example, those described in U.S. Pat. No. 3,615,556. Although the reason for this is not yet clear, it is believed that a cross-linking monomer (A) having a high reactivity as a hydrophilic functional group is employed in the present invention, while only a carboxyl group containing component is used in the prior art.

On the other hand, the butadiene type polymers used in the composition of the present invention can also be produced by reacting an aldehyde such as formaldehyde or acetaldehyde, an alcohol such as methanol or ethanol or an alkyleneoxide with a polymer which is prepared by copolymerizing such using an acid amide of an $\alpha,\beta$-unsaturated carboxylic acid instead of the above described N-alkanolamide of an $\alpha,\beta$-unsaturated carboxylic acid, by which an N-alkanolamide or N-alkoxyalkylamide is formed.

Application can be suitably carried out if the coating solution containing about 0.5 to 40% by weight, preferably 15 to 30% by weight, of the polymer is used and the coating carried out so as to provide a dry thickness of about 0.1 to 2 $\mu$, preferably 0.3 to 0.6 $\mu$.

In the method of forming a subbing layer of the present invention, it is not always necessary to add compounds which dissolve or swell the resin of the support, the so-called etching agents, e.g., hydroxybenzenes such as phenol, o-cresol, m-cresol, p-cresol, o-chlorophenol, p-chlorophenol, dichlorophenol, trichlorophenol, o-phenylphenol, resorcinol, methyl resorcinol or chlororesorcinol, etc. and acids such as acetic acid, monochloroacetic acid, dichloroacetic acid, trichloroacetic acid, trifluoroacetic acid, chloropropionic acid, dichloropropionic acid, benzoic acid or chlorobenzoic acid, etc. to the primer composition. However, one or more of these compounds can be added, if desired, to the primer composition. Further, since the primer solution used herein is an emulsion polymerized material, organic solvents are not necessary at application. However, if desired, organic solvents can be used. In addition, a reinforcing agent for the subbing layer (such as resorcinol, cresol, p-chlorophenol, benzoic acid, etc.), an adhesion improving agent for the emulsion layer such (as epichlorohydrin, 2,2'-bis(p-glycidyloxy)benzene, 1,3-bis(2'-3'-epoxy propoxy)ethane, muchchloric acid, glyceraldehyde, propargyacetal, etc.), an antistatic agent (such as LiCl, KCl, $CaCl_2$, $BaCl_2$, polyvinylbenzyltrialkylammoniumchloride, poly-(N,N-dimethyl-3,5-methylenepiperidinium chloride), polyoxyethylene sorbitan monolaurate, sodium stearate, sodium di-2-ethylhexyl-sulfosuccinate, etc.) and a matting agent may be added to the primer composition. Further, a cross-linking agent having a carboxyl group, a methylol group, a hydroxyl group, an oxirane group, an epoxy group, an isocyanate group, an acetal group, a vinyl group, an oxy group, a carbo-diimide group or a phenolic hydroxyl group, etc. or a metal cross-linking agent can be added thereto.

The present invention can be carried out, in general, as follows.

A primer composition of the present invention is applied to a resin support after, if desired, surface treating the resin support. The coating amount is adjusted using a squeezing roll, an air knife, a doctor blade, etc. The film is then dried in a drying zone, e.g., at about 110° C. for about 10 minutes, and rolled up. Then, an emulsion layer, such as a photographic emulsion layer, is applied on the formed subbing layer.

Evaluation of the adhesion between the photographic film support and the emulsion layer in the examples was carried out as follows.

(1) Adhesion strength test in a dry condition:

Cross-hatched scratch lines of about 4 mm were made on an emulsion layer of a dry raw film using a razor. An adhesive tape (e.g., Scotch tape, trade mark, produced by Minnesota Manufacturing and Mining Corp.) was placed on the emulsion layer and the tape was stripped instantly. In this test, Grade A designates the stripped area was 0 to 5%, Grade B designates the stripped area was 5 to 30% and Grade C designates the stripped area was 30 to 100%.

(2) Adhesion strength test in a wet condition in development.

Two scratch lines in the form of a cross were made on an emulsion layer of a film in a treating solution at each step of development, fixing or rinsing using a steel pen. Then, the scratch area was rubbed with a finger tip in a perpendicular direction to the scratch line. Grade A designates the emulsion layer did not peel in the scratched area, Grade B designates that the maximum peeling was within 5 mm and Grade C designates that the maximum peeling was above 5 mm.

(3) Non-adhesive property test.

5 pairs of samples were produced from 10 sheets of 35 × 35 mm film base having a subbing layer with the coated surface of each of the two samples of the pairs facing each other. The 5 pairs of samples were put between glass plates in a constant temperature-humidity area at 30° C. and 80% RH in a stack. Then, a 2 kg weight was put on the glass plate. They were allowed to stand for 24 hours in such a condition. The treated samples were slowly separated and the adhesion areas measured. Adhesion area 0%: Grade A; 0 to 1%: Grade A'; 2 to 33%: Grade B; 34 to 50%; Grade C; and above 50%: Grade D.

(4) Dry scratch resistance strength.

A load-variable type dry scratch resistance strength tester (HEDON - type 18; Shinto Kagaku Co.) was used. The measurement was carried out 5 times at 10 mm/sec. with a needle end of 0.4R (curvature radius). The mean point of the three determination values excluding the maximum value and the minimum value was calculated. (The sample used was allowed to stand at 23° C. ± 3° C., 65 ± 5% RH for 3 hours, and had a length of 252 mm and a width of 303 mm).

The present invention is illustrated in greater detail by reference to the following examples. However, the present invention is not to be construed as being limited to these examples. Unless otherwise indicated, all parts, percents, ratios and the like are by weight.

EXAMPLE 1

Emulsion polymers prepared by emulsion polymerization of the following monomers were applied respectively as a primer to biaxially stretched, oriented and crystallized polyethylene terephthalate film (PET) having a thickness of 200 $\mu$ and a width of 30 cm.

| Primer Composition 1 | (parts by weight) | Primer Composition 2 | (parts by weight) |
|---|---|---|---|
| Butadiene | 50 | Butadiene | 48 |
| Styrene | 42 | Styrene | 47 |
| Acrylic Acid | 0.40 | Itaconic Acid | 5.0 |
| Methacrylic Acid | 0.09 | | |
| N-Methylolacrylamide | 3.0 | | |

4 g of this primer (resin content 50%) was dissolved in 100 ml of distilled water and applied to a PET film at 20 ml per $m^2$. The film was then dried at 120° C. for 10 minutes. A silver halide emulsion was applied to the resulting coated film base. The adhesive strength in a dry condition and that in a wet condition at treatment, the non-adhesive property and the dry scratch resistance strength of the resulting photosensitive photographic film were compared with those of the film using the primer composition 2 which contained only an acid as the third component.

| | Primer Composition 1 | Primer Composition 2 |
|---|---|---|
| Adhesion Strength Test in a Dry Condition | A | A |
| Adhesion Strength Test in a Wet Condition | A | D |
| Non-Adhesive Property Test | A | D |
| Dry Scratch Resistance Strength | 1.5 | 1.0 |

The result of the adhesion strength test in a wet condition means that the coated surface obtained using the composition of the present invention has a good adhesive strength in a wet condition. The fact that the non-adhesive property was excellent means that there are less restrictions on storage of the coated products and thus the coated films have an advantage in that they can be stored for a long period of time in a stable condition until an emulsion is applied thereto. It is also understood that the coated films have an advantage that a blocking phenomenon does not occur during the application of the emulsion at high humidity. Further, it is understood that the strength of the surface of the subbing layer is excellent because the dry stretch resistance strength was higher. Furthermore, the photographic properties of the photographic film produced by applying an X-ray type emulsion to this coated base were excellent.

EXAMPLE 2

An emulsion polymer prepared by emulsion polymerization of the following monomers was applied as a primer to a biaxially stretched, oriented and crystallized polyethylene terephthalate film having a thickness of 200 $\mu$ and a width of 30 cm. The solid content of the latex was 2.5 parts by weight.

| Primer Composition 3 | parts by weight |
|---|---|
| Butadiene | 50 |
| Styrene | 41.5 |
| Acrylic Acid | 0.40 |
| Methacrylic Acid | 0.09 |
| N-Methylol Methacrylamide | 3.5 |

5 g of this primer (resin content 50%) was dissolved in 100 ml of distilled water and applied to a PET film at 20 ml per $m^2$. The film was then dried at 120° C. for 10 minutes. A silver halide emulsion was applied to this coated base film. The adhesive strength in a dry condition and that in a wet condition at treatment, the non-adhesive property and the dry scratch resistance strength of the resulting photosensitive photographic film were compared with those of a film using Primer Composition 2 which contained only the acid as the third component.

| | Primer Composition 3 | Primer Composition 2 |
|---|---|---|
| Adhesion Strength Test in a Dry Condition | A | A |
| Adhesion Strength Test in a Wet Condition | A | D |
| Non-Adhesive Property | A | D |
| Dry Scratch Resistance Strength | 1.4 | 1.0 |

It is understood from the above described results that the primer composition containing the N-alkanolamide is superior to that containing only the acid functional groups as the third component.

Further, the photographic properties of a photographic film produced by applying a litho-type emulsion to this coated base film were excellent.

EXAMPLE 3

An emulsion polymer prepared by emulsion polymerization of the following monomers was applied as a primer to a biaxially stretched, oriented and crystallized polyethylene terephthalate film having a thickness of 200 $\mu$ and a width of 30 cm. The solid content of the latex was 2.5 parts by weight.

| Primer Composition 4 | parts by weight |
|---|---|
| Butadiene | 50 |
| Styrene | 41.5 |
| Acrylic Acid | 0.40 |
| Methacrylic Acid | 0.09 |
| N,N-Dimethylol Acrylamide | 3.5 |

5 g of this primer (resin content: 50%) was dissolved in 100 ml of distilled water and applied to a PET film at 20 ml per $m^2$. The film was then dried at 120° C. for 10 minutes. A silver halide emulsion was applied to this coated base film. The adhesive strength in a dry condition and that in a wet condition at treatment, the non-adhesive property and the dry scratch resistance property of the resulting photosensitive photographic film were compared with these of a film using Primer Composition 2 which contained only the acid as the third component.

| | Primer Composition 4 | Primer Composition 2 |
|---|---|---|
| Adhesion Strength Test in a Dry Condition | A | A |
| Adhesion Strength Test in a Wet Condition | A | D |
| Non-Adhesive Property | A | D |
| Dry Scratch Resistance Strength | 1.4 | 1.0 |

It is understood from the above described results that the primer composition containing the N-alkanolamide is superior to that containing the acid functional groups only as the third component.

The photographic properties of a photographic film produced by applying an X-ray sensitive photographic emulsion to this coated base film were excellent.

EXAMPLE 4

An emulsion polymer produced by emulsion polymerization of the following monomers was applied as a primer to a biaxially stretched, oriented and crystallized polyethylene terephthalate film having a thickness of 200 $\mu$ and a width of 30 cm. The solid content of the latex was 2.5 parts by weight.

| Primer Composition 5 | parts by weight |
|---|---|
| Butadiene | 51 |
| Styrene | 44 |
| Itaconic Acid | 0.49 |
| N-Methylolacrylamide | 4.51 |

5 g of this primer (resin content 50%) was dissolved in 100 ml of distilled water and applied to a PET film at 20 ml per $m^2$. The film was then dried at 120° C. for 10 minutes. To this coated base film, a silver halide emulsion was applied. The adhesive strength in a dry condition and that in a wet condition, the non-adhesive property and the dry scratch resistance strength of the resulting photosensitive photographic film was compared with those of a film using Primer Composition 2 which contained only the acid as the third component.

| | Primer Composition 5 | Primer Composition 6 |
|---|---|---|
| Adhesion Strength Test in a Dry Condition | A | A |
| Adhesion Strength Test in a Wet Condition | A | D |
| Non-adhesive Property | A | D |
| Dry Scratch Resistance Strength | 1.6 | 1.0 |

It is understood from the above described results that the primer has excellent properties if N-alkanolamide groups are introduced as the fourth component even though the amount thereof is not within the acid content described in Japanese Patent Publication No. 3564/1973.

The photographic properties of a photographic film produced by applying an X-ray sensitive emulsion to the coated base film were excellent.

While the invention has been described in detail and with reference to specific embodiments thereof, it will be apparent to one skilled in the art that various changes and modifications can be made therein without departing from the spirit and scope thereof.

What is claimed is:

1. A photographic element which comprises a resin film or resin coated paper having superimposed thereon a subbing layer of a composition consisting essentially of a copolymer of components (A), (B) and (C), wherein component (A) is present in an amount from about 0.1 to 15% by weight, component (B) is present in an amount of from 0.01 to 5% by weight, and component (C) is present in an amount of from about 20 to 80% by weight, component (A) being a monomer containing therein a moiety of the general formula (I)

$$-\overset{|}{C}ON-\overset{OR_1}{\overset{|}{C}}HR_2 \qquad (I)$$

wherein $R_1$ and $R_2$ each is a hydrogen atom or an alkyl group having 1 to 12 carbon atoms, component (B) being a monomer containing a carboxyl group or a branched alkoxy carbonyl group selected from the group consisting of acrylic acid, methacrylic acid, ethacrylic acid, chloroacrylic acid, maleic acid, fumaric acid, itaconic acid, mesaconic acid, citraconic acid, sorbic acid, acryloxypropionic acid, itaconic acid anhydride, maleic acid anhydride or a mixture of these acids, and component (C) being at least one monomer selected from the group consisting of isoprene, butadiene, butene, octene, styrene, methylstyrene, methyl vinyl ether, ethyl vinyl ether, chloroethyl vinyl ether, butyl vinyl ether, unsubstituted vinyl esters, acrylates, methacrylates, and acrylonitrile and a hydrophilic colloid layer coated on the layer of said composition comprising said copolymer containing therein the moiety of the general formula (I), said copolymer having a molecular weight of about 10,000 to 1,000,000 and being present in an amount effective to provide increased adhesion, of a degree useful in photographic element, between said resin film or resin coated paper and said hydrophilic colloid layer, and said resin film or resin coated paper having at least one layer containing a light-sensitive silver halide, physical development nuclei as used in a diffusion transfer process or a diazo compound.

2. The photographic element of claim 1, wherein $R_2$ is a hydrogen atom or a methyl group.

3. The photographic element of claim 1, wherein $R_1$ is a hydrogen atom or a methyl group.

4. The photographic element of claim 1, wherein the moiety of the general formula (I) is an N-methylolamide moiety.

5. The photographic element of claim 1, wherein the monomer (B) component is an $\alpha,\beta$-unsaturated carboxylic acid or a derivative thereof.

6. The photographic element of claim 1, wherein the monomer (C) component is a diene.

7. The photographic element of claim 1, wherein said monomer (A) is present in said copolymer in an amount of about 0.1 to 15% by weight.

8. The photographic element of claim 1, wherein the monomer (B) component is present in said copolymer in an amount of about 0.01 to 5% by weight.

9. The photographic element of claim 1, wherein said layer of said composition comprising said copolymer containing therein the moiety of the general formula (I) adheres well to a hydrophilic photographic colloid layer.

10. The photographic element of claim 1, wherein said hydrophilic colloid layer is a photographic emulsion layer.

11. The photographic element of claim 1, wherein said support is a polyester resin film support or a polyester resin coated paper support.

12. The photographic element of claim 1, wherein said monomer (A) is N-methyloacrylamide, N-methylol methacrylamide or N,N-dimethylol acrylamide.

13. The photographic element of claim 1, wherein said monomer (B) is acrylic acid, methacrylic acid or itaconic acid.

14. The photographic element of claim 1, wherein said monomer (C) is butadiene or styrene.

15. The photographic element of claim 1, wherein said copolymer is water insoluble.

16. The photographic element of claim 1, wherein component (A) is present in an amount of from about 0.1 to 15% by weight, component (B) is present in an amount of from about 0.01 to 5% by weight, and component (C) is present in an amount of from about 20 to 80% by weight.

17. The photographic element of claim 1, wherein said subbing layer is applied so as to have a dry thickness of about 0.1 to 2$\mu$.

18. The photographic element of claim 1, wherein said hydrophilic colloid layer contains a light-sensitive silver halide.

19. The photographic element of claim 1, wherein said hydrophilic colloid layer contains physical development nuclei as used in a diffusion transfer process.

20. The photographic element of claim 1, wherein said hydrophilic colloid layer contains a diazo compound.

21. The photographic element of claim 1, wherein said hydrophilic colloid layer contains a coupler.

22. The photographic element of claim 1, wherein said hydrophilic colloid layer contains carbon black.

23. The photographic element of claim 1, wherein monomer (C) is methylmethacrylate.

24. The photographic element of claim 1, wherein monomer (C) is methyl acrylate.

25. The photographic element of claim 1, wherein said subbing layer contains epichlorohydrin, 2,2'-bis(p-glycidyloxy)benzene, 1,3-bis(2',3'-epoxy propoxy)ethane, mucochloric acid, glyceraldehyde, proparglyacetal, an antistatic agent, a matting agent or a cross-linking agent having a carboxyl group, a methylol group, an hydroxyl group, an oxirane group, an epoxy group, an isocyanate group, an acetal group, a vinyl group, an oxy group, a carbo-diimide group or a phenolic hydroxyl group, or a metal cross-linking agent.

26. The photographic element of claim 17, wherein said hydrophilic colloid layer contains a silver halide, physical development nuclei as used in a diffusion transfer process or a diazo compound.

27. The photographic element of claim 17, wherein said copolymer consists essentially of butadiene, styrene, acrylic acid, methacrylic acid and N-methylol acrylamide.

28. The photographic element of claim 17, wherein said copolymer consists essentially of butadiene, styrene, acrylic acid, methacrylic acid and N,N-dimethylol acrylamide.

29. The photographic element of claim 17, wherein said copolymer consists essentially of butadiene, styrene, itaconic acid and N-methylol acrylamide.

30. The photographic element of claim 17, wherein said copolymer consists essentially of butadiene, styrene, acrylic acid, methacrylic acid and N-methylol methacrylamide.

31. The photographic element of claim 16, wherein said subbing layer is applied so as to have a dry thickness of about 0.1 to 2 microns and wherein said hydrophilic colloid layer contains a silver halide, physical developing nuclei as used in a diffusion transfer process or a diazo compound.

* * * * *